United States Patent [19]

Jentsch

[11] 4,080,687

[45] Mar. 28, 1978

[54] DOOR CLOSER

[75] Inventor: Dietrich Jentsch, Ennepetal, Germany

[73] Assignee: Dorma-Baubeschlag G.m.b.H. & Co. K.G., Ennepetal-Voerde, Germany

[21] Appl. No.: 722,921

[22] Filed: Sep. 15, 1976

[30] Foreign Application Priority Data

Sep. 19, 1975 Germany ..... 2541790

[51] Int. Cl.[2] ..... E05F 3/10

[52] U.S. Cl. ..... 16/52; 16/51; 16/62; 16/56

[58] Field of Search ..... 16/49, 51, 52, 54, 68, 16/62, 56, 58, 61, 69, 82, 84, 48.5

[56] References Cited

U.S. PATENT DOCUMENTS

| | | | |
|---|---|---|---|
| 3,042,957 | 7/1962 | Muessel et al. | 16/49 |
| 3,079,629 | 3/1967 | Millard et al. | 16/52 |
| 3,335,452 | 8/1967 | Patriquin | 16/52 |
| 3,396,424 | 8/1968 | Russell et al. | 16/62 |
| 3,426,382 | 2/1969 | Lasier | 16/49 |
| 3,426,383 | 2/1969 | Lasier et al. | 16/62 |
| 3,546,734 | 12/1970 | Pollack et al. | 16/62 |
| 3,771,195 | 11/1973 | Tansley | 16/62 |
| 3,852,846 | 12/1974 | Slaybaugh | 16/62 |

*Primary Examiner*—Ronald Feldbaum
*Attorney, Agent, or Firm*—Michael J. Striker

[57] ABSTRACT

A door closer includes a cylinder-and-piston arrangement in which the piston is received in the cylinder for displacement between a rest position corresponding to a closed position of the door, and an end position corresponding to the fully open position of the door, through an intermediate position corresponding to a partly opened position of the door. The piston subdivides the interior of the cylinder into at least two compartments which are in communication with one another via at least two passages one of which is closable in any position of the piston by means of an electromagnetically operated valve, the other passage being open when the piston is between the rest and the intermediate position and closed when the piston is between the intermediate and the end position. A spring biases the piston toward the rest position so that, when the electromagnetically operated valve is opened, the spring will cause the door to close regardless of its position, while the spring will also close the door regardless of whether the electromagnetically operated valve is closed or opened, from any position between the above-mentioned partially open position of the door and the closed position of the door, due to the flow of a damping fluid between the two compartments through the other passage. The valve which closes and opens the other passage may be constructed as an elongated pin mounted on the cylinder and extending into the other passage, the pin having a first portion received in the other passage with clearance between the rest and the intermediate position of the piston, and a second portion sealingly received in the passage between the intermediate and the end position of the piston. The first and second portions may merge with one another via a conical portion which determines the size of the clearance when at least partially received in the other passage. The piston may have two piston heads each delimiting one of the compartments and connected with one another via a toothed rack under the formation of a third compartment between the two piston heads. A pinion of a door-closing linkage then meshes with the toothed rack. Additional passages and additional valves in such passages may be provided which permit overriding of the action of the electromagnetically operated valve by exerting force on the door, and the increase in the degree of opening of the door.

15 Claims, 3 Drawing Figures

II
III

DOOR CLOSER

BACKGROUND OF THE INVENTION

The present invention relates to a door closer in general, and more particularly to a door closer of the type capable of holding the door in a partially or fully open position.

There are already known various automatic door closing arrangements which are usually spring-biased to urge the door towards its closed position, and which almost invariably include damping arrangements of different types which prevent the door on which any of such closing arrangements is used from closing too rapidly and/or too noisily.

In one of the conventional door-closing arrangements of the above type, which is known, for instance, from the German published patent application DOS No. 2,303,934, there is provided a cylinder-and-piston unit the movable member of which is acted upon by a spring urging the same toward a rest position which corresponds to the closing position of the door. In this arrangement, the two compartments in which the piston subdivides the interior of the cylinder communicate with one another via a plurality of passages in which there are located various valves, such as a throttle valve, an electromagnetically operated valve, and at least one pressure-relief valve or a one-way valve. One of the compartments, which will be hereafter called a pressure compartment in that a damping medium in this compartment is at an elevated pressure as long as no external force is exerted upon the door, communicates with the other compartment, which will be hereafter referred to as a supply compartment in that it holds a supply of the damping liquid, via three channels or passages in one of which there is arranged a constriction and, in series therewith a holding valve which is held in its closing position by an electromagnetic arrangement provided that the latter is energized. Another of the above-mentioned passages or channels incorporates a one-way valve which opens in direction into the pressure compartment, the remaining channel or passage including a pressure relief valve which opens when the pressure within the pressure compartment substantially exceeds the normal operating pressure prevailing in such pressure compartment, that is, the pressure which is attributable to the action of the spring on the displaceable member of the cylinder-and-piston unit. Such pressure resulting in opening of the pressure-release valve may come into existence, for instance, when an external force acts on the fully or partly open door in the direction toward the closed position of the door, in addition to the force exerted upon the displaceable member of the cylinder-and-piston unit and, via the same, also on the door. In other words, the pressure-relief valve renders possible the overriding of the action of all the other valves and manual closing of the door regardless of the fact that the door may be originally held in a partly or fully open position by the electromagnetically operated valve.

As already mentioned above, the door closer of this type is capable of holding the door in connection with which the door closer is used in any desired partly or fully open position, owing to the presence of the electromagnetically operated valve, the electromagnet of which may be energized at will to close the passage associated with the electromagnetically operated valve to thereby arrest the displaceable member of the cylinder-and-piston unit in the then assumed position, thus preventing the door from moving toward the closed position. Of course, the door can still be manually opened to a greater extent due to the action of the one-way valve which permits flow of the damping fluid from the supply compartment into the pressure compartment, and can be manually closed by exerting a force on the door which is sufficient to open the pressure-relief valve to thus let the damping fluid escape from the pressure compartment into the supply compartment. On the other hand, when the electromagnet of the electromagnetically operated valve is de-energized, the pressure of the damping fluid in the pressure compartment will open the electromagnetically operated valve and the fluid will flow from the pressure compartment into the supply compartment, thus permitting the spring to displace the displaceable member of the cylinder-and-piston unit toward the rest position thereof with attendant closing of the door. The speed at which the door will move towards its closed position is determined by the size of the constriction of the throttle valve arranged in series with the electromagnetically operated valve.

This door closing arrangement is advantageous in many respects in that it permits manual adjustment of the position of the door whether or not the electromagnetically operated valve is in its open position, and also permits automatic closing of the door upon simple de-energization of the electromagnet which operates the electromagnetically operated valve. However, experience has shown that, up to a certain degree of partial opening of the door, it is disadvantageous if the door is held in such a partially open position by the electromagnetically operated valve, in that the door must be closed from such a partially open position either manually, or by deenergizing the electromagnet of the electromagnetically operated valve. Under many circumstances, however, closing of the door from such partly open position is highly desirable.

SUMMARY OF THE INVENTION

Accordingly, it is a general object of the present invention to avoid the disadvantages of the prior art.

More particularly, it is an object of the present invention to provide a door closing arrangement which is not possessed of the above-mentioned drawback.

Yet another object of the present invention is to so construct a door closing arrangement as to be capable of closing the door up to a certain degree of opening of the door, regardless of the fact that an electromagnetically operated valve is operative for holding the door in any partially open position.

A concomitant object of the present invention is to provide a door closing arrangement which is simple in construction, inexpensive to manufacture and reliable in operation.

A still further object of the present invention is to devise a door-closing arrangement which automatically closes the door on deenergization of the electromagnet of the electromagnetically operated holding valve, and which permits the manual adjustment of the position of the door regardless of the energization or deenergization of the electromagnet.

In pursuance of these objects and others which will become apparent hereafter, one feature of the present invention resides in a door closer which comprises, in combination, a cylinder-and-piston arrangement which is adapted to be mounted at a door to be closed and which includes a cylinder member defining a chamber having a longitudinal axis, a piston member located in the chamber and subdividing the same into two compartments for a damping fluid each at one axial side of the piston member, one the members being displaceable relative to the other member axially of the chamber between a rest position and an end position through an intermediate position, and biasing means which urges the displaceable member toward the above-mentioned rest position. The door closer of the present invention further comprises means for displacing the displaceable member from the rest position toward the end position in dependence upon the extent of movement of the door from a closed position towards an open position of the door. First and second passage means are provided in the door closer each of which communicates the above-mentioned compartments with one another, first and second valve means being arranged in and being operative for opening and closing the first and second passage means, respectively. The door closer further comprises first closing means for selectively closing the first valve means in any position of the displaceable member to thereby interrupt flow of the damping fluid through the first passage means; and second closing means for closing the second valve means only in such positions of the displaceable member which are between the intermediate and end positions of the displaceable member to thereby interrupt flow of the damping fluid through the second passage means. When the door closer is constructed in the above-mentioned manner, the damping fluid is expelled by the action of the biasing means on the displaceable member from one of the compartments into the other compartment through at least the second passage means when the displaceable member is between the rest position and the intermediate position with attendant displacement of the displaceable member toward the rest position and closing of the door, whereas the damping fluid holds the displaceable member against displacement when the displaceable member is between the intermediate position and the end position and the first valve means is closed.

According to a further concept of the present invention, the first and second passage means have a common passage portion, and a throttle valve means is arranged in the common passage portion and is operative for determining the rate of flow of the damping fluid at least from the one compartment into the other compartment when at least one of the first and second valve means is open. Preferably, the common passage portion is situated intermediate the one compartment and the respective remainders of the first and second passage means. Furthermore, the first passage means may include two branch passages, the first valve means being interposed in one of the branch passages. Then, the door closer may further comprise a one-way valve which is located in the other branch passage and is operative for letting the damping fluid flow from the other compartment into the one compartment when the pressure in the other compartment exceeds a predetermined value, thereby providing a bypass flow for the damping fluid around the first valve means when the displaceable member is subjected to an external force having a tendency to displace the displaceable member toward an end position thereof.

When the door closer is constructed in the above-mentioned manner, the electromagnetically operated holding valve is ineffective for holding the door in its partly open position so long as the angle of opening of the door is within a certain range, in that the damping fluid can escape from the one compartment into the other compartment through the throttling valve and the second passage means which is not closed under these circumstances. Only when the door is opened beyond the above-mentioned range within which the door will always automatically close, that is, when the displaceable member of the cylinder-and-piston arrangement reaches and exceeds the intermediate position thereof so that the second valve means closes the second passage means, the door will be held in the assumed partially or fully open position so long as the electromagnetically operated holding valve, which constitutes the first closing means and which includes an electromagnet having an armature acting on the first valve member in the closing sense when the electromagnet is energized, closes the first passage. On the other hand, when the electromagnet of the electromagnetically operated valve is deenergized, the pressure in the one compartment will open the first valve and the damping fluid will be able to escape from the one compartment into the other compartment through the first passage, with attendant movement of the door towards its closed position. The escaping damping fluid flows through the throttling valve which, by its throttling action, determines the speed at which the door will be closing.

The basic concept of the present invention can be realized in many ways. However, in a very advantageous and currently preferred embodiment of the invention, the second passage means includes a passage section in the piston member and the second valve means includes a valve member which has at least a portion which is closingly receivable in the passage section, the second closing means including a support portion which is rigidly connected to the cylinder and to the valve member so that the displacement of the displaceable member toward the end position results in relative displacement of the passage section and the valve member until the latter closes the former in the intermediate position of the displaceable member and maintains it closed up to the end position of the displaceable member. As currently preferred, the valve member and the support portion are of one-piece with one another, and have the shape of a pin. The valve member may also have an additional portion which is receivable in the passage section with clearance when the displaceable member is between the rest and intermediate position, so that the damping fluid is permitted to flow through the clearance from the one compartment into the other compartment. The valve member may further have a transition portion between the first-mentioned portion and the additional portion, the transition portion merging with the above-mentioned portions and converging in direction from the first-mentioned portion to the additional portion. The transition portion is operative for controlling the size of the clearance when it is at least partly received in the passage section.

In a currently preferred embodiment of the present invention, the piston member includes one piston head which delimits the one compartment, another piston head which delimits the other compartment, and means for connecting the piston heads with one another with axial spacing from each other so that the piston heads define an additional compartment with one another. The passage section which has been mentioned previously is provided in the other piston head and communicates the other compartment with the additional compartment.

This embodiment of the door closer of the present invention results in a construction which is easy to manufacture and reliable in operation and achieves a common control of the element which delimits the one compartment, that is, the one piston head, on the one hand, and the element which acts as the second closing means, that is, the other piston head, on the other hand, in a particularly advantageous way.

The connecting means includes a connecting element rigidly connected with the piston heads and spacing the same from one another. The displacing means for displacing the displaceable member may than include a toothed rack portion on the connecting element, and a pinion received in the additional compartment and meshing with the toothed rack portion, the pinion having at least one shaft portion which extends from the additional compartment to the exterior of the cylinder member for connection to the door.

As already mentioned above, at least the second passage means communicates with the additional compartment, but preferably also the first passage means. The arrangement may then comprise third passage means which communicates the additional compartment with the one compartment, and a check valve in the third passage means which opens in direction from the additional toward the one compartment to thereby permit displacement of the displaceable member toward the end position thereof, and thus the opening of the door.

In addition thereto, an auxiliary passage means may communicate the additional compartment with the one compartment, and a pressure relief valve may be accommodated in the auxiliary passage means which opens in direction from the one toward the additional compartment when the pressure in the former exceeds a predetermined value, to thereby permit displacement of the displaceable member toward the rest position thereof, when the displaceable member is subjected to an external force additional to the force exerted upon the same by the biasing means and having a tendency to displace the displaceable member towards the rest position thereof.

Moreover, it may be advantageous and it is contemplated by the present invention to so construct the electromagnetically operating holding valve that, when the pressure in the one compartment exceeds a predetermined value, independently of the fact whether the electromagnet which controls the electromagnetically operating holding valve is energized or deenergized, the door can be manually closed even in the blocking or energized position of the electromagnet without any need for the energizing the latter, by applying sufficient force on the door in the sense closing the same. Incidentally, this external force need be applied to the door only for so long as the displaceable member of the cylinder-and-piston unit is between the intermediate and the end position thereof. In other words, it is only necessary to move the door to such a position in which the displaceable member assumes its intermediate position, after which the second closing means opens the passage section of the second passage means and the biasing means will displace the displaceable member further all the way to the closed position of the door and rest position of the displaceable member.

A yieldable support of the holding valve by the electromagnet can be achieved in several different ways. So, for instance, a spring can be interposed between the movable armature of the electromagnet and the valve proper, which spring permits the valve member to be lifted from its seat when the pressure in the first passage means exceeds the above-mentioned predetermined value. Instead, the electromagnet may include a plunger-type armature which yields when the pressure in the first conduit means exerts sufficient force on the holding valve which overcomes the force with which the plunger-type armature is held in its extended position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figures 1, 2, 3:
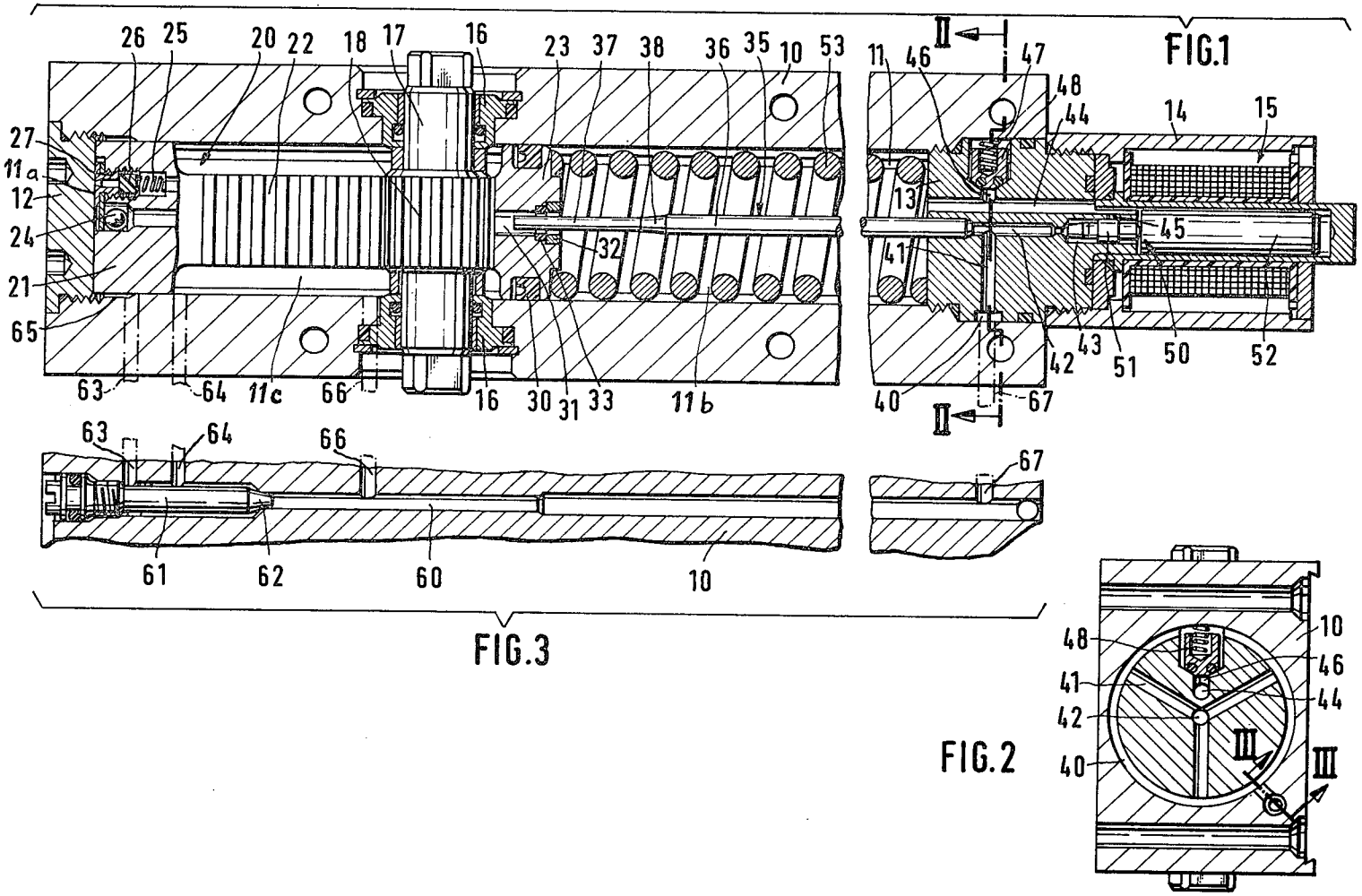
FIG. 1 is a longitudinal sectional view of the door closer of the present invention.
FIG. 2 is a sectional view taken on line II—II of FIG. 1.
FIG. 3 is a partial sectional view taken on line III—III of FIG. 2.

Referring now to the drawing in detail, and first to FIG. 1 thereof, it may be seen that the automatic door closer of the present invention includes an elongated housing 10, hereafter called a cylinder, which may be of a cylindrical, quadratic or rectangular outer appearance. The cylinder 10 circumferentially bounds a chamber 11 which may be of a cylindrical shape or the like. A plug 12 closes the chamber 11 at one end of the cylinder 10, and a plug 13 is arranged at the other end of the cylinder 10 and sealingly closes the chamber 11 at this end and has mounted thereon a socket 14 which surrounds and houses an electromagnet 15. Two coaxial stepped bores extend transversely to the elongation of the cylinder 10 and accommodate therein bearing plugs 16 in which there is mounted for rotation a shaft 17 which is provided, in the central region thereof, with a toothed pinion 18. Conventional seals are arranged at the interfaces between the bearing plugs 16 and the cylinder 10, on the one hand, and the shaft 17, on the other hand. Both end portions of the shaft 17, on the other hand. Both end portions of the shaft 17 are so configurated that a link connected to the door to be closed or a part of a linkage so connected can be mounted on either one of the end portions of the shaft 17 to translate the movement of the door between the closed and the fully open position into rotation of the shaft 17 and of the pinion 18 about their axes. Such configuration of the free ends of the shaft 17 renders it possible to use the door closer under all conditions, particularly regardless of the fact whether the door opens in the clockwise or the counterclockwise direction.

A piston, designated in toto with reference numeral 20, is accommodated in the chamber 11 for displacement longitudinally thereof. The piston 20 includes a first piston head 21, a second piston head 23, and a connecting element 22 which interconnects the piston heads 21 and 23 and keeps them spaced from one another. The piston heads 21 and 23 subdivide the chamber 11 into a first or pressure compartment **11*a*, a second or supply compartment 11*b*, and a third or additional compartment 11c, the latter being located between the piston heads 21 and 23**.

The connecting element 22 is constructed as a toothed rack which meshes with the pinion 18. Consequently, the rotation of the shaft 17 results in a longitudinal displacement of the piston 20 in the chamber 11 of the cylinder 10, with attendant flow of a damping fluid present in the chamber 11 between the compartments 11a, 11b and 11c in a manner which will be discussed presently.

A one-way valve 24 is arranged in a passage provided in the first piston head 21 and communicating the compartments 11a and 11c with one another, the one-way valve 24 including a spherical element and a seat formed by a step of the afore-mentioned passage. The one-way valve opens in direction to the pressure compartment 11a, thus permitting flow of the damping fluid thereinto from the additional compartment 11c.

Acting in parallelism with the one-way valve 24, there is arranged in the first piston head 21 a pressure relief valve including a valve member 26, and a spring 25 acting on the valve member 26. A sleeve 27 is arranged in the passage which includes the pressure relief valve, such sleeve 27 having or forming a seat for the valve member 26. The pressure-relief valve 25 to 27 opens when the pressure in the pressure compartment 11a exceeds a predetermined value so that, under these circumstances, the damping fluid will be able to escape from the pressure compartment 11a into the additional compartment 11c through the pressure relief valve 25 to 27.

A packing ring 30 circumferentially surrounds the second piston head 23, being accommodated in a circumferential groove thereof, and sealingly separating the compartments 11b and 11c from one another. The second piston head 23 further has a central passage 31 in which there is accommodated an elastic sealing ring 33 which is supported in the central passage 31 by means of a ring 32. A pin 35, which is centrally supported on the plug 13, extends into the passage 31. The pin or needle 35 includes a portion 36 of a larger diameter, and a portion 37 of a smaller diameter. The diameter of the portion 36 is so selected that the portion 36 is sealingly received in the sealing ring 33, while the portion 37 defines with the sealing ring 33 a clearance through which the damping fluid can flow between the compartments 11b and 11c. The pin 35 further includes a transition portion 38 of a generally frustoconical configuraton which extends between and merges with the portions 37 and 36 of the pin 35.

The plug 13 is formed with an external circumferential groove 40 which is particularly clearly seen in FIG. 2, and generally radial bores 41 extend from the groove 40 to an axial bore 42 which merges with an axial bore 43 provided with a valve seat. Adjacent the bore 42, there is provided in the plug 13 an elongated bore 44 which is offset from the axis of the plug 13 but generally parallel thereto. A transverse bore 45 communicates the bore 44 with the bore 43, and a further transverse bore 46 communicates the bore 44 with the annular groove 40. The transverse bore 46 has a stepped configuration to form a valve seat, and a valve member 48 is accommodated in the transverse bore 46 and is pressed by a spring 47 against the aforementioned valve seat.

A holding valve member 50 is shiftably received in the bore 43, the valve member 50 having a cylindrical portion 51 adapted to cooperate with the transverse bore 45 in dependence on the axial position of the valve member 50. In the illustrated position of the door closer of the present invention, the cylindrical portion 51 closes the transverse bore 45. An axially displaceable armature 52 of the electromagnet 15 acts on the valve member 50, the pressure of the damping medium in the bore 42 acting on the valve member 50 in the opposite direction.

A helical spring 53 is arranged between the plug 13 and the second piston head 23, the spring 53 urging the piston 20 towards its illustrated rest position and also serving as an energy accumulator. Preferably, the spring 53 is pre-compressed in the illustrated position.

As particularly seen in FIG. 3 in comparison with FIGS. 1 and 2, a stepped bore 60 is provided in the cylinder 10, extending parallel to the chamber 11. At the left end of the stepped bore 60 as seen in FIG. 3, there is arranged a throttle valve 61 which has a throttling portion 62 of a generally frustoconical configuration, which throttling portion 62 defines a throttling gap with a valve seat provided in the stepped bore 60. The throttle valve 61 is received in the stepped passage 60 with clearance, and passages 63 and 64 communicate this clearance with the chamber 11. The passage 63 communicates with an enlarged end portion 65 of the chamber 11, while the passage 64 communicates with the additional compartment 11c in the illustrated rest position of the piston 20, which communication can be interrupted by the first piston head 21 when the same is displaced in the rightward direction. A further passage 66 communicates the stepped bore 60 with the additional compartment 11c in any position of the piston 20. Finally, a further transverse passage 66 extends from the stepped bore 60 to the annular groove 40 of the plug 13. As already mentioned above, not only the chamber 11, but also the various passages and bores are filled with a damping fluid, such as a hydraulic liquid.

Having thus described the construction of the door closer of the present invention, the operation thereof will now be discussed in some detail. As mentioned previously, the drawings illustrate the door closer in the rest position which it assumes when the door at which the door closer is mounted is in its closed position. For the discussion of the operation of the door closer, it will be preliminarily disregarded whether the electromagnet 15 is energized or deenergized.

When the door is being opened from its fully closed position, the shaft 17 will be rotated by means of a linkage which is connected to the door and to the shaft 17 and which is entirely conventional and thus has not been illustrated. The pinion 18 which is mounted on, or is of one piece with, the shaft 17 meshes with the toothed rack 22 and thus displaces the piston 20 towards the right as considered in FIG. 1. As a result of the displacement of the piston 20, the pressure compartment 11a which is located to the left of the first piston head 21 increases in volume while the supply compartment 11b which is located to the right from the second piston head 23 and which accomodates the spring 53 decreases in volume to a corresponding extent. As a result of this increase and decrease in the volumes of the compartments 11a and 11b, the damping fluid flows through the annular clearance between the sealing ring 33 and the portion 37 of the pin 35 into the additional compartment 11c which accommodates the toothed rack 22, and the damping fluid continues to flow through the one-way valve 24 into the pressure compartment 11a. This flow of the damping fluid continues until the transition portion 38 of the pin 35 is fully accommodated in the sealing ring 33 and the larger-diameter portion 36 of the pin 35 sealingly closes the passage 31, in cooperation with the sealing ring 33. When this happens, the afore-discussed path of flow of the damping fluid from the supply compartment 11*b* into the pressure compartment 11*a* through the additional compartment 11*c* is obstructed. Despite this obstruction of the afore-mentioned path of flow, the piston 20 can be further displaced rightwardly against the force of the spring 53, that is, the door can be further moved towards its fully open position in that the damping fluid can flow from the supply compartment 11*b* located to the right from the second piston head 23 through the bore 44, the transverse bore 46 around the pressure-relief valve 47, 48, lifted by the pressure of the damping fluid in the bore 44, into the annular groove 40 and from there through the additional transverse passage 67, the stepped bore 60 and the passage 66 into the additional compartment 11*c* located leftwardly of the second piston head 23, and from there again through the one-way valve 24 into the pressure compartment 11*a* which is located to the left of the first piston head 21. Thus, the door can be opened not only irrespective of the position of the holding valve 50, but also under the circumvention of the throttle valve 61, 62. As the door moves from its closed position to its fully open position, the piston 20 will move from the illustrated rest position to an intermediate position in which the portion 36 of the pin 35 starts cooperating with the sealing ring 33 and obstructing the passage 31, and further toward an end position which corresponds to a fully open position of the door.

Now, when the opening movement of the door, which results in the compression of the spring 53 which acts on the piston 20, is terminated when the piston 20 is between the rest position and the intermediate position, that is, when the sealing ring 33 defines the clearance with the smaller-diameter portion 37 of the pin 35, the spring 53 will expend its accumulated energy on displacing the piston 20 in the leftward direction, with concomitant closing of the door. This is rendered possible by the fact that the damping fluid will be able to escape from the pressure compartment 11*a* during the movement of the piston 20 towards its rest position, through the passages 63 and 64, around the throttle valve 61, 62, through the stepped bore 60 and from there through the passage 66 into the additional compartment 11*c*. From the compartment 11*c*, the damping fluid continues to flow through the clearance between the sealing ring 33 and the smaller-diameter portion 37 of the pin 35 into the supply compartment 11*b*. When the movement of the door towards its closed position is enhanced by exertion of an external force acting on the door, in addition to the force of the spring 53 acting on the piston 20, the pressure in the pressure compartment 11*a* cannot increase to an impermissible extent in that the pressure-relief valve 25 to 27 opens when the pressure in the pressure compartment 11*a* exceeds the above-mentioned predetermined value so that the damping fluid will flow directly from the pressure compartment 11*a* into the additional compartment 11*c* through the pressure relief valve 25 to 27, and from there through the clearance in the passage 31 into the supply compartment 11*b*.

On the other hand, when the opening movement of the door is terminated only after the larger-diameter portion 36 of the pin 35 is sealingly received in the sealing ring 33, whereby the passage 31 is obstructed, the further performance of the door closer of the present invention will be controlled by the holding valve 50, 51. When this holding valve 50, 51 is held by the armature 52 of the electromagnet 15 in the closed position thereof, the damping fluid cannot escape from the pressure compartment 11*a*, inasmuch as only the stepped bore 60, the additional transverse passage 67, the transverse bore 41 and the bore 42 are available for this purpose, of which the latter is closed by the holding valve 50, 51. As a consequence of this, the door will be held in the selected partially or fully opened position. However, when a force attempting to close the door is applied to the latter, such external force being sufficient to generate a pressure in the pressure compartment 11*a* which exceeds a predetermined value, such elevated pressure will simultaneously also exist in the passages 63, 64, 66, in the stepped bore 60, in the additional transverse passage 67, in the annular groove 40, in the transverse bore 41, and in the bore 42, and will shift the holding valve 50, 51, together with the armature 52, in the rightward direction so that the damping fluid will be permitted to flow through the transverse bore 45 and the bore 44 into the supply compartment 11*b*. Thus, the door can be also closed when widely or fully open, provided that an external force of sufficient magnitude is exerted on the door. During such closing movement of the door, the damping fluid at elevated pressure contained in the pressure compartment 11*a* can also open the pressure relief valve 25 to 27 in the event that the throttle valve 61, 62 is so adjusted as to create a sufficient pressure drop between the pressure compartment 11*a* and the additional compartment 11*c*.

When it is desired that the door be automatically closed from the above-mentioned blocked partially or fully opened position of the door, without the need for manually closing the door, it is merely necessary to disconnect the electromagnet 15 from the source of electric current and thus deenergize the same. Under these circumstances, the force exerted by the spring 53 on the piston 20 is sufficient to generate a pressure in the pressure compartment 11*a* which suffices for moving the holding valve 50, 51, together with the armature 52, to the opening position of the holding valve 50, 51, such pressure again being transmitted to the holding valve 50, 51 through the passage 66, on the one hand, and the passages 63, 64, on the other hand, further through the stepped bore 60, the additional transverse passage 67, the annular groove 40, the transverse bore 41 and the bore 42. Under these circumstances, the door again will be closed automatically due to the action of the spring 53 on the piston 20. It will be appreciated that, when the holdng valve 50, 51 is open, it is of no consequence which one of the portions 36, 37 and 38 cooperates with the sealing ring 33 in the passage 31.

Furthermore, when it is desired to open the door more fully from a position which corresponds to a position of the piston between the intermediate and the end position, the damping fluid will flow from the supply compartment 11*b* through the bore 44, the transverse bore 46 around the pressure relief 47, 48, into the annular groove 40, and from there through the additional transverse passage 67, the stepped bore 60, the passage 66 into the additional compartment 11*c*, and from there around the oneway valve 25 into the pressure compartment 11*a*.

It is to be further mentioned that the parallel arrangement of the two passages 63, 64, in connection with the provision of the enlarged end portion 65 of the chamber 11, has the purpose of circumventing the throttling valve 61, 62 during the last part of the movement of the door towards its closed position, that is, during the last part of the movement of the piston 20 towards its rest position. Namely, during such last part of movement or displacement, the damping fluid will be able to flow from the pressure compartment 11*a* through the enlarged portion 65 and the passage 63, and into the additional compartment 11*c* into the passage 64, obviating the need for the damping fluid to flow through the throttling gap defined in the stepped bore 60 by the frusto-conical portion 62 of the throttle valve 61. From the additional compartment 11*c*, the damping fluid will then flow through the passage 41 and the clearance between the sealing ring 33 and the smaller-diameter portion 37 of the pin 35 into the supply compartment 11*b*. It will be appreciated that this circumvention of the throttle valve 61, 62 will permit the door to close at a speed which is sufficient for having the latching means of the door engage.

It will be understood that each of the elements described above, or two or more together, may also find a useful application in other types of constructions differing from the types described above.

While the invention has been illustrated and described as embodied in a door closer, it is not intended to be limited to the details shown, since various modifications and structural changes may be made without departing in any way from the spirit of the present invention. So, for instance, the closing of a branch conduit constituted by the passage 66, the additional compartment 11*c*, and the annular clearance between the sealing ring 33 and the portion 37 of the pin 35 in dependence on the position of the piston 20 could be also achieved in a different manner, such as by a separate element which could be controlled by the shaft 17 or any element of the linkage which rotates the shaft 17 independently of the piston 20. Also, the electromagnet 15, instead of having a plunger-type armature 52, could be so constructed that the armature thereof would be movable only between two end positions. In this situation, a spring could be interposed between the armature 52 and the holding valve 50, 51 so as to enable the holding valve 50, 51 to yield and open when the pressure in the pressure compartment 11*a* exceeds the above-mentioned predetermined value.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an arrangement for controlling the position of a door element which is mounted for movement relative to an opening of a wall element between a fully open position and a closed position through a predetermined partly open position, a combination comprising a cylinder-and-piston unit including a cylinder member and a piston member each connectable to one of the elements, said cylinder member defining an elongated chamber and said piston member being located in said chamber to subdivide the same into two compartments for a damping fluid and so displaceable longitudinally of said chamber as to assume therein an end position in the fully open position of the door element, an intermediate position in the predetermined partly open position of the door element, and a rest position in the closed position of the door element; biasing means interposed between said cylinder member and said piston member and urging the latter toward said rest position thereof; first and second passage means each communicating said compartments with one another; first and second valve means operative for opening and closing said first and second passage means, respectively; first closing means for selectively closing said first valve means in any position of said piston member in said chamber to thereby interrupt flow of the damping fluid through said first passage means; and second closing means for closing said second valve means only in such positions of said piston member in said chamber which are between said intermediate position and said end position thereof to thereby interrupt the flow of the damping fluid through said second passage means, whereby the damping fluid is expelled by the action of said biasing means on said piston member from one of said compartments into the other compartment through at least said second passage means when said piston member is between said rest position and said intermediate position thereof with attendant movement of the door element toward said closed position whereas the damping fluid holds said piston member against displacement when the latter is between said intermediate position and said end position and said first valve means is closed.

2. A combination as defined in claim 1, wherein said first and second passage means have a common passage portion; and futher comprising throttle valve means in said common passage portion and operative for determining the rate of flow of the damping fluid at least from said one into said other compartment when at least one of said first and second valve means is open.

3. A combination as defined in claim 2, wherein said common passage portion is situated intermediate said one compartment and the respective remainders of said first and second passage means.

4. A combination as defined in claim 1; wherein said first passage means includes two branch passages, said first valve means being interposed in one of said branch passages; and further comprising a one-way valve located in the other branch passage and operative for permitting flow of the damping fluid from said other into said one compartment when the pressure in said other compartment exceeds a predetermined value, thereby providing a bypass for the damping fluid around said first valve means when said piston member is subjected to an external force having a tendency to piston said displace member toward said end position thereof.

5. A combination as defined in claim 1, wherein said first closing means includes an electromagnet having an armature acting on said first valve member in the closing sense when said electromagnet is energized.

6. A combination as defined in claim 1, wherein said second passage means includes a passage section in said piston member; wherein said second valve means includes a valve member having at least a portion which is closingly receivable in said passage section; and wherein said second closing means includes a support portion rigidly connected to said cylinder member and to said valve member, whereby the displacement of said piston member toward said end position results in relative displacement of said passage section and said valve member until the latter closes the former in said intermediate position of said piston member and maintains it closed up to said end position of said piston member.

7. A combination as defined in claim 6, wherein said valve member and said support portion are of one piece with one another.

8. A combination as defined in claim 6, wherein said valve member has an additional portion which is receivable in said passage section with clearance when said piston member is between said rest and said intermediate position thereof, whereby the damping fluid is permitted to flow through said clearance from said one into said other compartment.

9. A combination as defined in claim 8, wherein said valve member has a transition portion between said portion and said additional portion thereof, said transition portion merging with and converging in direction from said portion to said additional portion and being operative for controlling the size of said clearance when at least partly received in said passage section.

10. A combination as defined in claim 6, wherein said piston member includes one piston head delimiting said one compartment, another piston head delimiting said other compartment, and means for connecting said piston heads to one another with axial spacing from each other so that said piston heads define an additional compartment with each other; and wherein said passage section is provided in said other piston head and communicates said other compartment with said additional compartment.

11. A combination as defined in claim 1, wherein said piston member includes one piston head delimiting said one compartment, another piston head delimiting said other compartment, and means for connecting said piston heads to one another.

12. A combination as defined in claim 11, wherein said connecting means includes a connecting element rigidly connected with said piston heads and spacing the same from one another so that said piston heads define an additional compartment with one another.

13. A combination as defined in claim 12; wherein said displacing means includes a toothed rack portion on said connecting element, and a pinion received in said additional compartment and meshing with said toothed rack portion, said pinion having at least one shaft portion extending from said additional compartment to the exterior of said cylinder member for connection to the door.

14. A combination as defined in claim 12, wherein at least one of said first and second passage means communicates with said additional compartment; and further comprising third passage means communicating said additional compartment with said one compartment, and a check valve in said third passage means which opens in direction from said additional toward said one compartment to thereby permit piston of said displaceable member toward said end position thereof.

15. A combination as defined in claim 12, wherein at least one of said first and second passage means communicates with said additional compartment; and further comprising auxiliary passage means communicating said additional compartment with said one compartment, and a pressure relief valve in said auxiliary passage means which opens in direction from said one toward said additional compartment when the pressure in the former exceeds a predetermined value to thereby permit displacement of said piston member toward said rest position thereof when said piston member is subjected to an external force additional to the force exerted upon the same by said biasing means and having a tendency to displace said piston member toward said rest position thereof.

* * * * *